US008929592B2

(12) United States Patent
Marks et al.

(10) Patent No.: US 8,929,592 B2
(45) Date of Patent: Jan. 6, 2015

(54) CAMERA-BASED 3D CLIMATE CONTROL

(75) Inventors: Tim K. Marks, Newton, MA (US); Michael J. Jones, Belmont, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 189 days.

(21) Appl. No.: 13/418,678

(22) Filed: Mar. 13, 2012

(65) Prior Publication Data

US 2013/0243240 A1 Sep. 19, 2013

(51) Int. Cl.
*G06K 9/00* (2006.01)

(52) U.S. Cl.
USPC ..... 382/103

(58) Field of Classification Search
None
See application file for complete search history.

(56) References Cited

U.S. PATENT DOCUMENTS 6,658,136 B1 * 12/2003 Brumitt ..... 382/103
2003/0235341 A1 * 12/2003 Gokturk et al. ..... 382/243
2006/0126933 A1 * 6/2006 Porikli ..... 382/173
2007/0092245 A1 * 4/2007 Bazakos et al. ..... 396/427
2008/0297621 A1 * 12/2008 Sun et al. ..... 348/224.1
2011/0205366 A1 * 8/2011 Enohara et al. ..... 348/159
2011/0254950 A1 * 10/2011 Bibby et al. ..... 348/135
2011/0320013 A1 12/2011 Chen et al.
2012/0014562 A1 * 1/2012 Berkovich et al. ..... 382/103

FOREIGN PATENT DOCUMENTS

EP 2363657 A2 9/2011
JP 2010190432 A 9/2010
WO 2010074329 A1 7/2010

* cited by examiner

*Primary Examiner* — Stephen R Koziol
*Assistant Examiner* — Delomia Gilliard
(74) *Attorney, Agent, or Firm* — Dirk Brinkman; Gene Vinokur

(57) ABSTRACT

A climate control unit is controlled by constructing background and foreground models of an environment from images acquired of the environment by a camera. The background model represents the environment when unoccupied, and there is one foreground model for each person in the environment. A 2D location of each person in the environment is determined using the background and foreground models. A 3D location of each person is determined using the 2D locations and inferences made from the images. The controlling of the climate control unit is according to the 3D locations.

15 Claims, 2 Drawing Sheets

CAMERA-BASED 3D CLIMATE CONTROL

FIELD OF THE INVENTION

This invention relates generally to climate control units, and more particularly to controlling air conditioner (AC) units according to the locations of objects (people) in an environment using a camera.

BACKGROUND OF THE INVENTION

In the prior art, various techniques have been used to improve the performance of climate control units, such as an air conditioner (AC) or heating units.

3D sensors have been used to obtain 3D location information. 2D cameras have also been used, but not for estimating 3D locations. 2D sensors other than cameras, such as motion sensors, have not been used to obtain 3D locations.

U.S. Pat. No. 6,645,066, "Space-Conditioner Control Employing image-Based Detection of Occupancy and Use," uses a conventional 2D camera to detect an occupancy rate, an occupant activity rate, and an occupant activity class. That system only counts people, but does not determine the locations of the people in the environment.

U.S. Pat. App. Pub. No. US 200910193, "Person Location Detection Apparatus and Air Conditioner," uses a time-of-flight (TOF) 3D sensor to determine 3D locations of people in an environment. The publication describes a TOF sensor, and provides a method for detecting a person at a location given a time sequence of depth maps to control an AC unit.

In U.S. Pat. No. 5,634,846, "Object Detector for Air Conditioner," motion detection is performed with an infrared (IR) sensor with a Fresnel lens. The system detects the amount of motion in different zones in a field of view of the sensor, which provides very rough information about the 2D locations of people.

Jap. Pat. JP02197747 uses a thermal IR camera to detect people and determine their 2D locations to control an air flow from an AC unit. 3D locations are not described.

SUMMARY OF THE INVENTION

The embodiments of the invention provide a method and system for controlling climate control units, such as air conditioner (AC) or heating units. The method takes input from a 2D monocular camera to determine 3D locations of objects in an environment to be climatically controlled.

As an advantage, a 2D monocular camera is inexpensive, when compared with 3D sensors, has better resolution than other types of 2D sensors, and can have a relatively high frame rate to enable real-time object tracking.

The embodiments can not only count objects, but also locate and track the objects.

Using a time-of-flight (TOF) sensor or other 3D sensors makes location determination simpler, but such sensors are generally more expensive than a 2D monocular camera.

Instead of obtaining rough 2D locations, we perform accurate 3D tracking.

DETAILED DESCRIPTION OF THE PREFERRED EMBODIMENTS

Figure 1:
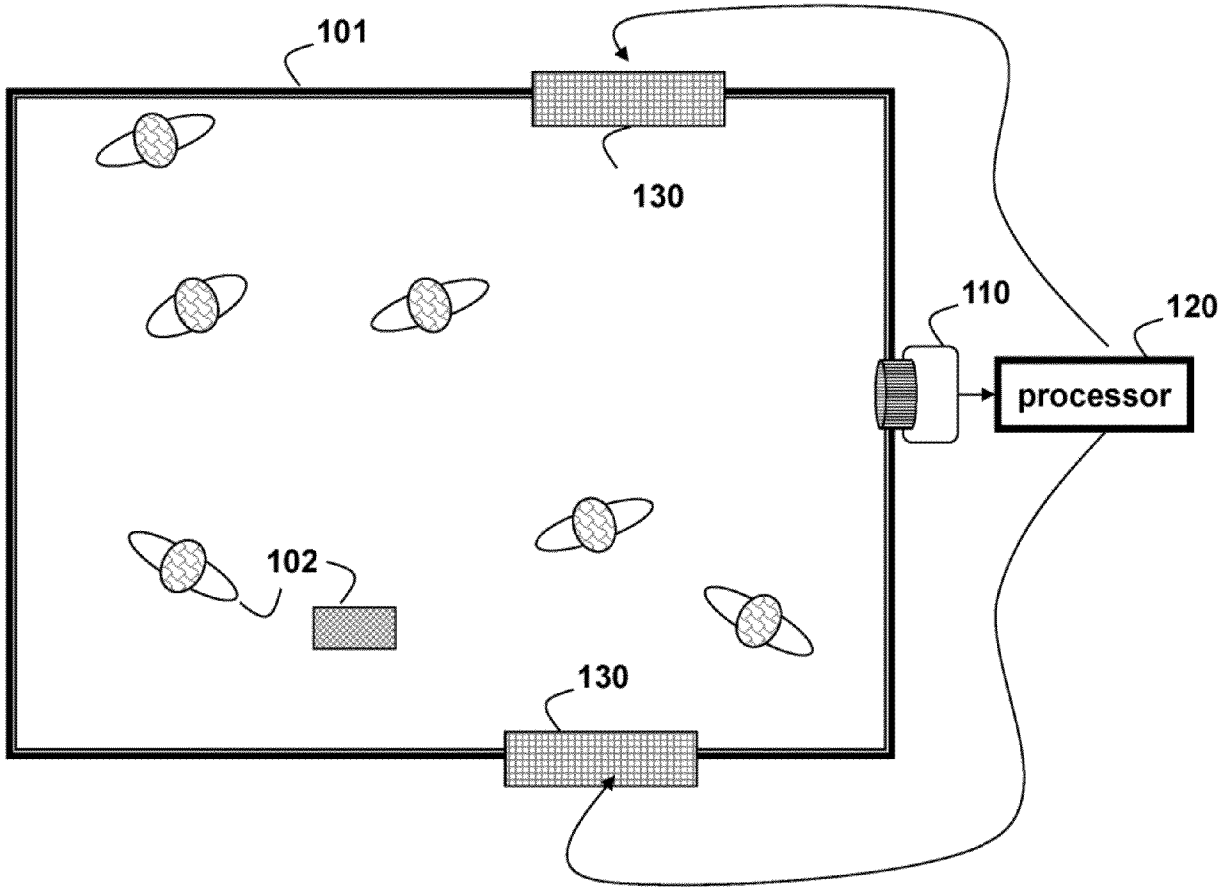
FIG. 1 shows a schematic of a system for controlling a climate in an environment according to embodiments of the invention.
Figure 2:
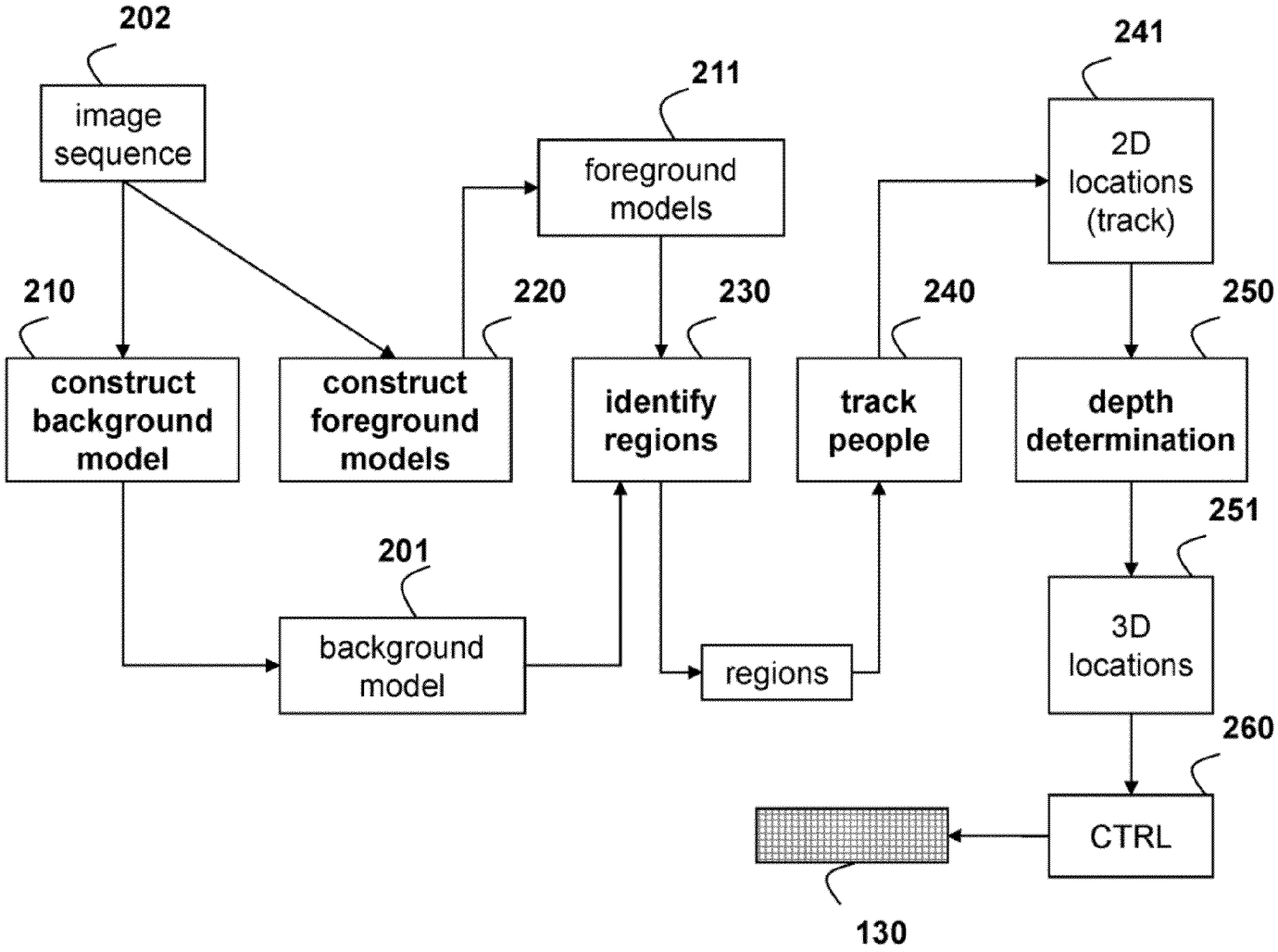
FIG. 2 is a flow diagram of a method for controlling a climate in an environment according to embodiments of the invention.

As shown in FIGS. 1 and 2 respectively, our system and method include a 2D monocular camera 110. The camera can be omni-directional. The camera can be equipped with a wide-angle lens. The camera sensor can optionally detect near-infrared light. The camera has a view of an environment 101.

The environment can include a set of objects 102, e.g., people, animals, perishable goods, etc. The objects can move. The set can be the null set, i.e., there are no objects in the environment.

Output of the camera is connected to a processor 120. The output can be in a form of a sequence of one or more images (such as video frames). A control signal is fed back to one or more climate control units 130. The signal is dependent on the location of the objects in the environment. In some embodiments, the camera is incorporated into the climate control unit(s) 130.

As shown in FIG. 2, a method performed in the processor tracks objects (e.g., people) in the field of view of the camera, and determines 3D locations of the objects to improve the performance of the climate control units. For example, the units can be in OFF or STANDBY mode when the environment or a particular portion of the environment is unoccupied (does not contain any people). As another example, the units may direct air toward or away from people in the environment, and may change the velocity of the air depending upon the distance to each person.

If the environment includes multiple climate control units, for example, in an office space in which warm or cold air can be directed at every desk, then the local environments can be individually controlled.

As shown in FIG. 2, our method constructs 210 a background model 201 of the environment using a sequence of one or more images 202 acquired of the environment. The background model represents the appearance of the environment when not occluded by moving objects such as people.

The background model is a mixture of one or more Gaussian distributions per pixel that estimates the distribution of background intensities for each pixel in the image. The intensities are represented in a color space, such as grayscale values, rgb color values, or near-infrared intensities.

A foreground model 211 is also constructed 220 for each person in the environment during operation of the system from a sequence of images 202.

Each foreground models can be a histogram in a color space of all pixels in the foreground region, or it can be a mixture of Gaussian distributions for all pixels in the foreground region.

Alternatively, the foreground model can be a template. A template is typically a region of an image that covers the foreground object.

Pixels associated with foreground objects such as people will have a low probability of being classified as background, because they do not correspond to the background model.

The models are used to identify 230 regions of pixels that are likely to be associated with people in images 202. The models can be updated dynamically as the images are acquired. Updating the background and foreground models as new images are acquired can improve the accuracy of the system when there are changes in the appearance of the background or foreground due to factors such as changes in lighting, moving furniture, and changes in a person's pose.

The 2D location of each person is tracked 240 using the background and foreground models. The sequence of locations of a person over time is called a track 241. The track is used to estimate the location of the person in a next image.

Using the 2D location of a person and other information inferred from the image sequence, the depth of the person is determined 250, which enables the person's 3D location 251 to be estimated.

In one embodiment, inferences can be determined by a head detector, or head and shoulders detector. The inferences can be used to verify whether a tracked object is a person and also to determine the 2D location and 2D size of the head. By assuming that 3D head sizes of people are substantially similar, the depth may be determined 250 from the 2D size of the head. Combining the estimate of the depth (i.e., distance from the camera) with the 2D location information yields the estimated 3D location 251 of the person. The number and 3D locations of people in the environment is then used to improve the control of the climate control unit(s).

In an alternative embodiment, to find the depth of each person, a 3D ground plane of the environment is automatically estimated from one or more images in the sequence 202. The 2D location of the person's feet is estimated from the track. The 2D location of a point on the ground plane is sufficient to determine the distance to the camera, and thus by assuming that the person's feet are located on the ground plane, we obtain the depth 250 and hence the 3D location 251.

Other object shape characteristics for known objects can also be used to determine the depth. For example, the shape can be represented by a bounding box, and the depth can be estimated from a size of the bounding box.

The 3D location is processed by a controller 260, which can be part of the processor, to generate control signals for the unit(s) 130.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A system for controlling a climate control unit, comprising:

a 2D monocular camera;

a processor, connected to an output of the camera, wherein the processor is configured to construct a background model and foreground models of an environment from images acquired of the environment by the camera, wherein the background model represents the environment when unoccupied, and there is one foreground model for each person in the environment, and a 2D location of each person is determined from the background and foreground models, and a 3D location of each person is determined from the estimated 2D location and inferences made from the images; and a controller configured to generate a control signal for the climate control unit based on the 3D locations.

2. The system of claim 1, wherein the camera is omnidirectional.

3. The system of claim 1, wherein the camera has a wide-angle lens.

4. The system of claim 1, wherein the processor tracks the objects in the images.

5. The system of claim 1, wherein the inferences include a 2D size of a head of each person.

6. The system of claim 1, wherein the inferences include a 2D size of a head and shoulders of each person.

7. The system of claim 1, wherein the inferences include the estimation of a 3D ground plane of the environment.

8. The system of claim 1, wherein the inferences include a 2D bounding box for each person.

9. The system of claim 1, wherein for each pixel location, the background model is a mixture of one or more Gaussian distributions in a color space.

10. The system of claim 1, wherein each foreground model is a histogram in a color space.

11. The system of claim 1, wherein each foreground model is a mixture of one or more Gaussian distributions in a color space.

12. The system of claim 1, wherein each foreground model is a template.

13. The system of claim 1, wherein the camera is incorporated into the climate control unit.

14. The system of claim 1, wherein the foreground and background models are updated as the images are acquired.

15. A method for controlling a climate control unit, comprising a 2D monocular camera:

constructing background and foreground models of an environment from images acquired of the environment by a camera, wherein the background model represents the environment when unoccupied, and there is one foreground model for each person in the environment;

determining a 2D location of each person in the environment using the background and foreground models;

determining a 3D location of each person using the 2D locations and inferences made from the images; and controlling the climate control unit based on the 3D locations.

* * * * *